US010695827B2

(12) United States Patent
Fujikawa

(10) Patent No.: US 10,695,827 B2
(45) Date of Patent: Jun. 30, 2020

(54) LIGHT METAL INJECTION MOLDING MACHINE

(71) Applicant: SODICK CO., LTD., Kanagawa (JP)

(72) Inventor: Misao Fujikawa, Kanagawa (JP)

(73) Assignee: SODICK CO., LTD., Kanagawa (JP)

( * ) Notice: Subject to any disclaimer, the term of this patent is extended or adjusted under 35 U.S.C. 154(b) by 0 days.

(21) Appl. No.: 16/424,498

(22) Filed: May 29, 2019

(65) Prior Publication Data

US 2019/0366424 A1 Dec. 5, 2019

(30) Foreign Application Priority Data

Jun. 4, 2018 (JP) ..... 2018-106892

(51) Int. Cl.
*B22D 17/30* (2006.01)
*B22D 17/32* (2006.01)
*B22D 17/14* (2006.01)

(52) U.S. Cl.
CPC ..... *B22D 17/30* (2013.01); *B22D 17/145* (2013.01); *B22D 17/32* (2013.01)

(58) Field of Classification Search
CPC ..... B22D 17/14; B22D 17/145; B22D 17/30; B22D 17/32
USPC ..... 164/259, 303, 305, 312, 316
See application file for complete search history.

(56) References Cited

U.S. PATENT DOCUMENTS 10,293,405 B2 * 5/2019 Fu et al. ..... B22D 17/02
2016/0016228 A1 * 1/2016 Kikuchi et al. ..... B22D 17/30
164/147.1

FOREIGN PATENT DOCUMENTS

JP 3184294 7/2001

* cited by examiner

*Primary Examiner* — Kevin P Kerns
(74) *Attorney, Agent, or Firm* — JCIPRNET

(57) ABSTRACT

A light metal injection molding machine includes a melting unit, a material supply device, and an inert gas supplier. The material supply device includes a supply cylinder and a lower shutter. The supply cylinder includes a passage which communicates vertically, a supply opening disposed on an upper side of the passage and to which a molding material is fed, and a discharge opening which is disposed on a lower side of the passage and discharges the molding material to a material supply port of the melting unit. The lower shutter is disposed in the supply cylinder to open and close the passage, and the molding material is placed on the lower shutter when the passage is closed. The lower shutter has at least one vent-hole that allows an inert gas supplied from below the lower shutter to pass when the passage is closed.

17 Claims, 7 Drawing Sheets

LIGHT METAL INJECTION MOLDING MACHINE

CROSS-REFERENCE TO RELATED APPLICATION

This application claims the priority benefit of Japanese Application Serial No. 2018-106892, filed on Jun. 4, 2018. The entirety of the above-mentioned patent application is hereby incorporated by reference herein and made a part of this specification.

BACKGROUND

Technical Field

The disclosure relates to a light metal injection molding machine. The disclosure particularly relates to a light metal injection molding machine provided with a material supply device for supplying a molding material, which is a light metal, to a melting unit.

Description of Related Art

Japanese Patent No. 3184294 discloses an injection molding apparatus for molding a metal molded body, which is provided with a material supply chamber that supplies a metal material to a heating cylinder. The material supply chamber is partitioned by a first shutter and a second shutter that can be opened and closed. The second shutter is disposed below the first shutter. After air is sucked by a vacuum pump through a port disposed above the first shutter and a port disposed between the first shutter and the second shutter, an inert gas is supplied into the material supply chamber. The inert gas prevents deterioration of the metal material.

The disclosure provides a light metal injection molding machine which includes a material supply device for supplying a molding material to a material supply port of a melting unit and fills a space of the material supply device near the material supply port with an inert gas rapidly and uniformly.

SUMMARY

According to the disclosure, a light metal injection molding machine is provided, which includes: a melting unit including a material supply port supplying a molding material which is a light metal, and melting the molding material to generate a molten metal; a material supply device supplying the molding material to the material supply port; and an inert gas supplier supplying an inert gas to the material supply device. The material supply device includes a supply cylinder and a lower shutter. The supply cylinder includes a passage which communicates vertically, a supply opening which is disposed on an upper side of the passage and to which the molding material is fed, and a discharge opening which is disposed on a lower side of the passage and discharges the molding material to the material supply port. The lower shutter is disposed in the supply cylinder to open and close the passage, and the molding material is placed on the lower shutter when the passage is closed. The lower shutter has at least one vent-hole that allows the inert gas supplied from below the lower shutter to pass when the passage is closed.

DESCRIPTION OF THE EMBODIMENTS

A light metal injection molding machine of the disclosure can fill a space of a material supply device near a material supply port with an inert gas rapidly and uniformly.

Figure 1:
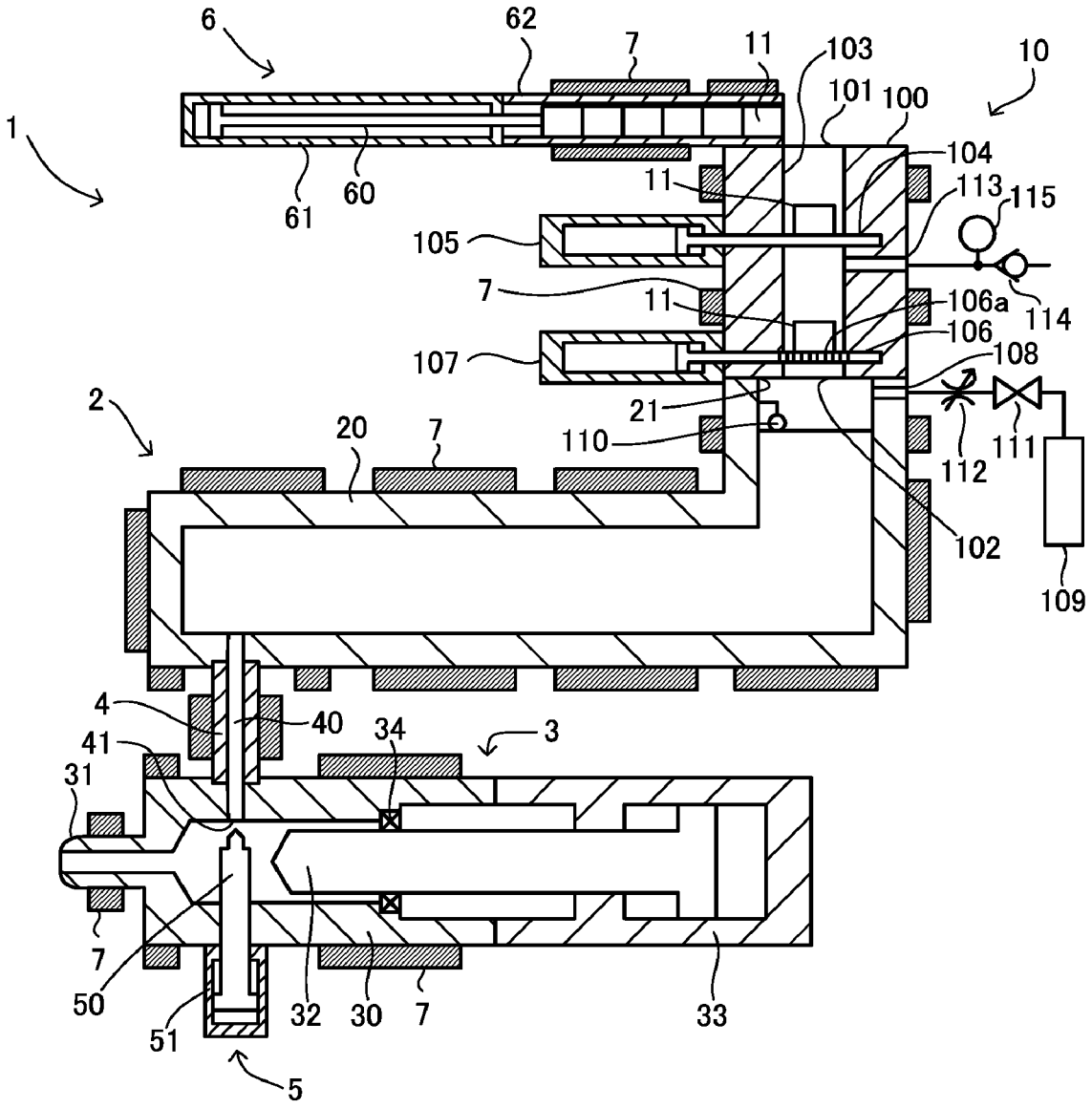
FIG. 1 is a cross-sectional view showing a schematic configuration of an injection device of a light metal injection molding machine before measurement.
Figure 2:
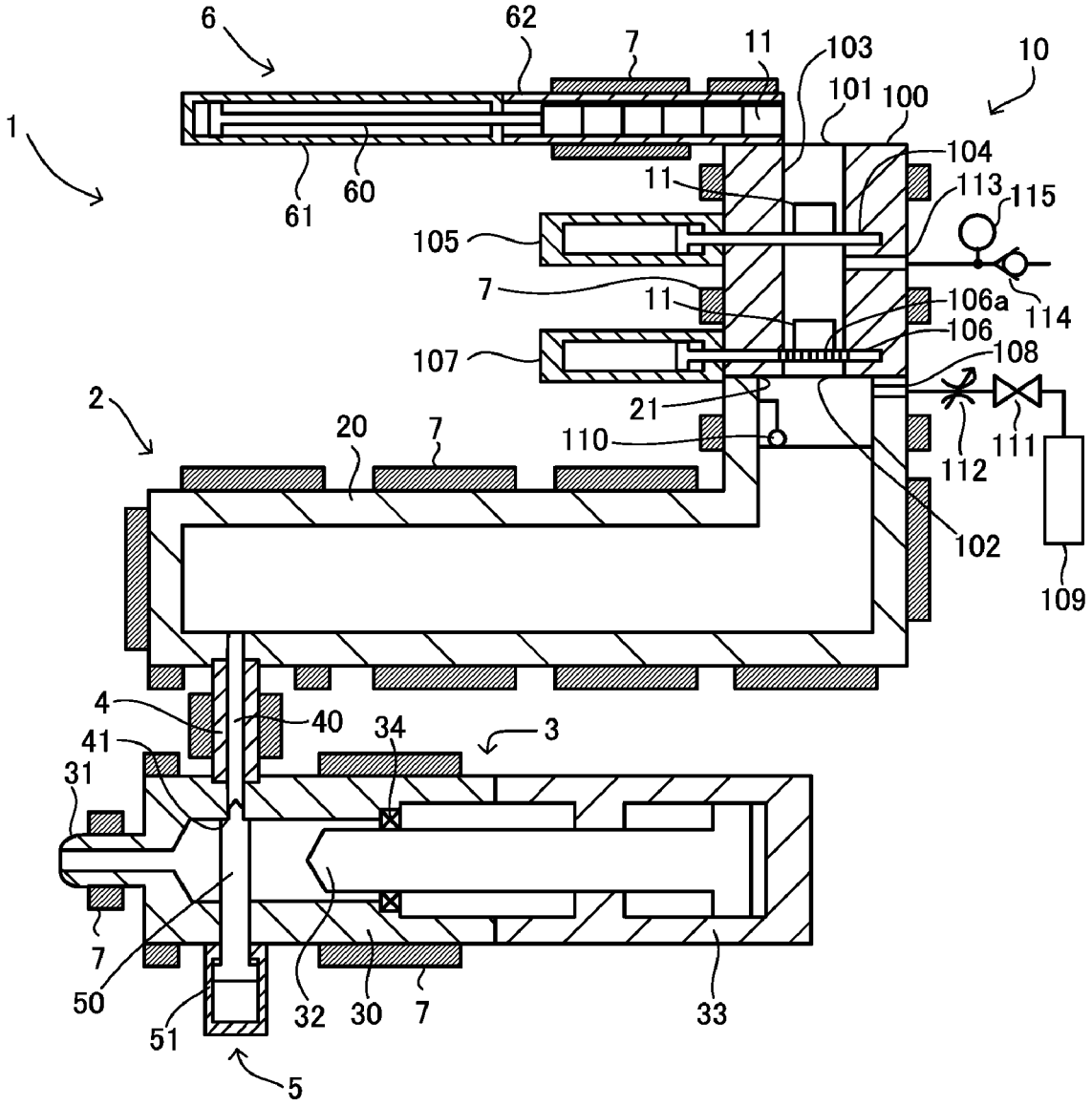
FIG. 2 is a cross-sectional view showing a schematic configuration of the injection device of the light metal injection molding machine after measurement is completed.

In one embodiment to be described, a light metal injection molding machine includes an injection device 1, a clamping device, and a controller. FIG. 1 and FIG. 2 show a schematic configuration of the injection device 1. In the following description, a left side of FIG. 1 and FIG. 2 is defined as a front end side of the injection device 1, and a right side of FIG. 1 and FIG. 2 is defined as a rear end side of the injection device 1. The injection device 1 melts a molding material 11 to generate a molten metal and measures a predetermined amount of the molten metal for injection. In this specification, an unmelted light metal material is referred to as the molding material 11. In addition, the molding material 11 melted into a liquid form is referred to as the molten metal. The clamping device (not shown) opens and closes a mold mounted on the light metal injection molding machine, and clamps the mold in a closed state. The mold (not shown) includes a fixed mold, and a movable mold that moves with respect to the fixed mold. When the mold is closed, that is, when the fixed mold and the movable mold are brought into contact with each other, a cavity space is formed. A molded product is formed by the molten metal injected into the cavity space. The controller (not shown) controls the light metal injection molding machine that includes the injection device 1 and the clamping device. Though not described in detail, various types of driving sources such as hydraulic type, pneumatic type and electric type may be used appropriately as the driving sources in the driving devices for various devices.

In the light metal injection molding machine, first, the clamping device closes and clamps the mold. Next, the injection device 1 injects the molten metal to the cavity space of the mold and fills the cavity space with the molten metal. After the molten metal in the mold cools down and solidifies, the clamping device opens the mold for taking out the molded product.

Specifically, the molding material 11 is a light metal. The light metal in the disclosure refers to a metal that has a specific gravity of 4 or less. Practically, aluminum and magnesium are particularly effective to serve as the molding material 11. A shape of the molding material 11 is not particularly limited. If the molding material 11 is aluminum, parts to be in contact with the molten metal are basically covered with a cermet-based material so as not to melt down. In this specification, aluminum and magnesium are defined including their respective alloys.

As shown in FIG. 1 and FIG. 2, the injection device 1 includes a melting unit 2, an injection unit 3, a junction 4, and a backflow prevention mechanism.

The melting unit 2 includes a melting cylinder 20. A heater 7 is attached to the melting cylinder 20. The melting cylinder 20 is heated by the heater 7 to melt the molding material 11 to generate the molten metal. The melting cylinder 20 has a cylinder hole for melting the molding material 11 and storing the molten metal. The melting cylinder 20 is installed horizontally above the injection unit 3. A material supply port 21, which is an opening for supplying the molding material 11, is formed in an upper portion on the rear end side of the melting cylinder 20. The molding material 11 supplied from the material supply port 21 is immersed in the molten metal in the cylinder hole of the melting cylinder 20 and is melted. The melting unit 2 may be in other forms as long as it has the material supply port 21 and can store the molten metal. For example, the melting unit 2 may include a bucket type melting furnace and a lid for covering a top of the melting furnace except for a portion provided the material supply port 21.

The injection unit 3 includes an injection cylinder 30, an injection nozzle 31, a plunger 32, and a plunger driving device 33. The injection cylinder 30 has a cylinder hole for measuring the molten metal sent from the melting unit 2. The injection cylinder 30 is installed horizontally below the melting unit 2. The injection nozzle 31 is attached to a front end of the injection cylinder 30 to be in contact with the mold during molding. The plunger 32 moves back and forth in the injection cylinder 30 to push out the molten metal in the cylinder hole of the injection cylinder 30 and inject the molten metal from the injection nozzle 31. The plunger driving device 33 drives the plunger 32. Heaters 7 are attached to the injection cylinder 30 and the injection nozzle 31.

A reduced diameter part 34 is disposed at a rear end portion of the injection cylinder 30 to serve as a sealing means between the injection cylinder 30 and the plunger 32. An inner diameter of the reduced diameter part 34 is smaller than an inner diameter of the cylinder hole of the injection cylinder 30 and larger than an outer diameter of the plunger 32. In the present embodiment, the injection cylinder 30 and the reduced diameter part 34 are formed separately, but the injection cylinder 30 and the reduced diameter part 34 may be formed integrally. A sealing material, which is a light metal in a semi-molten state, is generated between the reduced diameter part 34 and the plunger 32. The semi-molten state refers to a transient state where the metal is transforming from a liquid state to a solid state and has viscosity and lower fluidity than that in the liquid state. The rear end portion of the injection cylinder 30 is controlled to be at a predetermined temperature by the heater 7, and the sealing material is generated from the molten metal. The sealing material seals between the rear end portion of the injection cylinder 30 and the plunger 32 to prevent the molten metal from leaking behind the reduced diameter part 34. In addition, the sealing material reduces a friction between the injection cylinder 30 and the plunger 32 and allows the plunger 32 to move more smoothly. The sealing material is engaged with an annular groove formed on an inner circumferential surface of the reduced diameter part 34 or a step between the cylinder hole of the injection cylinder 30 and the reduced diameter part 34. Therefore, even if the sealing material receives pressure via the molten metal during injection, the sealing material does not come out from the rear end portion of the injection cylinder 30. Nevertheless, the sealing means between the injection cylinder 30 and the plunger 32 is not limited to the above embodiment, and various other means can be used.

The junction 4 connects the melting unit 2 and the injection unit 3. More specifically, the junction 4 is connected to a lower part of a front end side of the melting cylinder 20 and an upper part of a front end side of the injection cylinder 30. The junction 4 includes a communication path 40 that serves as a flow path of the molten metal. The communication path 40 communicates a lower part of a front end side of the cylinder hole of the melting cylinder 20 with an upper part of a front end side in the cylinder hole of the injection cylinder 30. In this way, the molten metal generated in the melting cylinder 20 is sent to the injection cylinder 30 through the communication path 40 of the junction 4. A heater 7 may be attached to the junction 4.

The backflow prevention mechanism opens the communication path 40 to supply the molten metal from the melting cylinder 20 to the injection cylinder 30 during measurement, and closes the communication path 40 during injection, so as to prevent the molten metal from flowing back to the melting cylinder 20. The backflow prevention mechanism is, for example, a backflow prevention device 5. The backflow prevention device 5 includes a seat 41, a stem 50 to be seated on the seat 41, and a stem driving device 51 for driving the stem 50. In the present embodiment, the backflow prevention device 5 is disposed on the injection cylinder 30 side. That is, the seat 41 is formed around an opening of the communication path 40 on the injection cylinder 30 side. The stem 50 is disposed to pass through the inside of the injection cylinder 30 to be seated on the seat 41. The stem driving device 51 is disposed below the injection cylinder 30 and enables the stem 50 to reciprocate with respect to the seat 41. FIG. 1 shows a state where the stem 50 is separated from the seat 41 and the communication path 40 is opened. FIG. 2 shows a state where the stem 50 is in contact with the seat 41 and the communication path 40 is closed.

In another embodiment, the backflow prevention device 5 may be disposed on the melting cylinder 20 side. In this embodiment, the seat 41 is formed around the opening of the communication path 40 on the melting cylinder 20 side. The stem 50 is disposed to pass through the inside of the melting cylinder 20 to be seated on the seat 41. The stem driving device 51 is disposed above the melting cylinder 20 and enables the stem 50 to reciprocate with respect to the seat 41.

In yet another embodiment, the backflow prevention device 5 may be disposed in the junction 4. In this embodiment, the seat 41 is formed on the inner surface of the communication path 40. The stem 50 is disposed to pass through the communication path 40 to be seated on the seat 41. The stem driving device 51 is disposed on a side surface of the junction 4 and enables the stem 50 to reciprocate with respect to the seat 41.

In addition, the backflow prevention mechanism may have other configurations as long as it can open and close the communication path 40. For example, the backflow prevention mechanism may be a valve such as a rotary valve or a check valve disposed in the communication path 40.

The stem 50 may have piping inside for circulating a cooling medium. The cooling medium cools down a tip part of the stem 50. By cooling the tip part of the stem 50 right before the stem 50 is seated on the seat 41, the molten metal around the tip part of the stem 50 may be solidified to form a solidified material that has appropriate flexibility. The solidified material formed on the tip part of the stem 50 can be deformed following the seat 41 when the stem 50 is seated on the seat 41 to reduce the gap between the stem 50 and the seat 41. In this way, the molten metal is prevented from leaking out between the stem 50 and the seat 41.

According to the injection device 1 of the present embodiment described above, first, as shown in FIG. 1, the backflow prevention device 5 opens the communication path 40, and the molten metal in the melting cylinder 20 is sent to the injection cylinder 30 via the communication path 40. Next, the plunger 32 in the injection cylinder 30 moves backward, and the molten metal is stored in the injection cylinder 30 while being measured. When the measured molten metal reaches a desired amount, the backflow prevention device 5 closes the communication path 40 as shown in FIG. 2. Then, the plunger 32 moves forward to push out the molten metal in the injection cylinder 30. The molten metal passes through the injection nozzle 31 and is injected into the cavity space of the mold.

Figure 3:
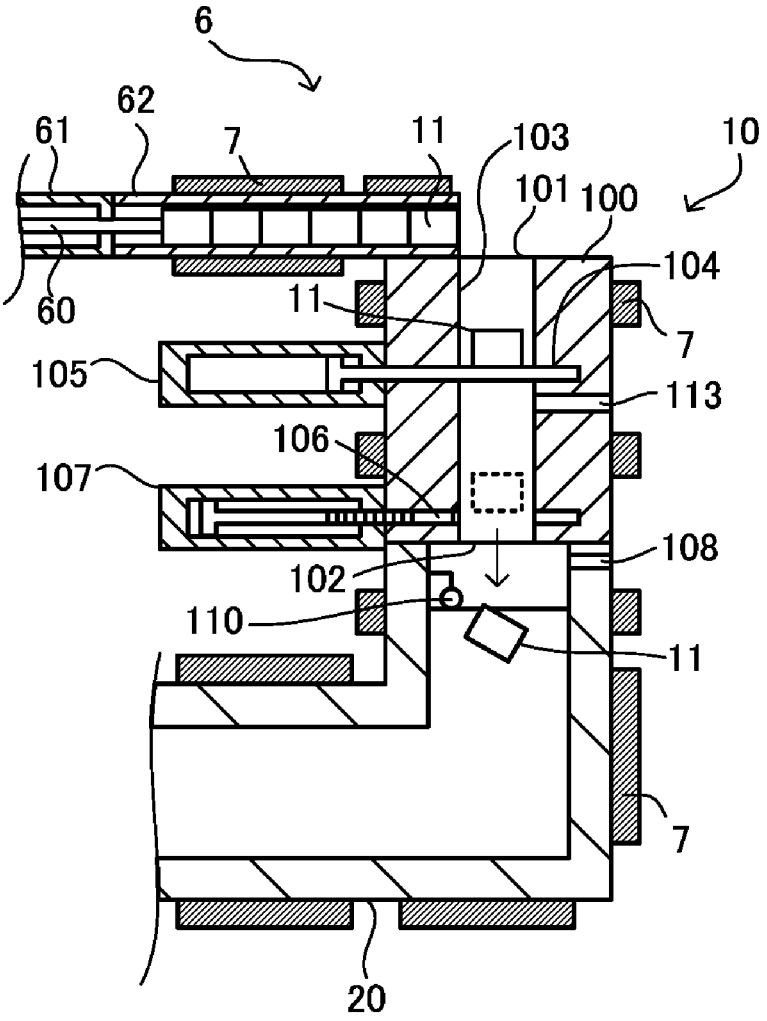
FIG. 3 is an enlarged view of a material supply device, showing a state where a molding material placed on a lower shutter is supplied to a material supply port.
Figure 4:
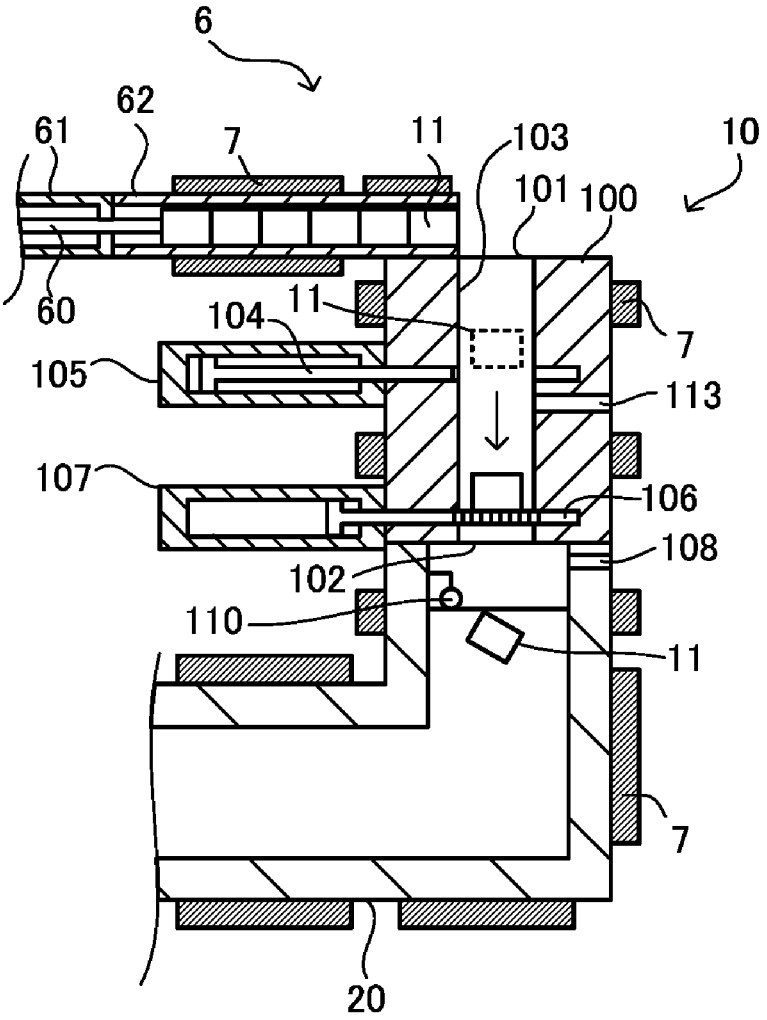
FIG. 4 is an enlarged view of the material supply device, showing a state where the molding material placed on an upper shutter is fed to the lower shutter.
Figure 5:
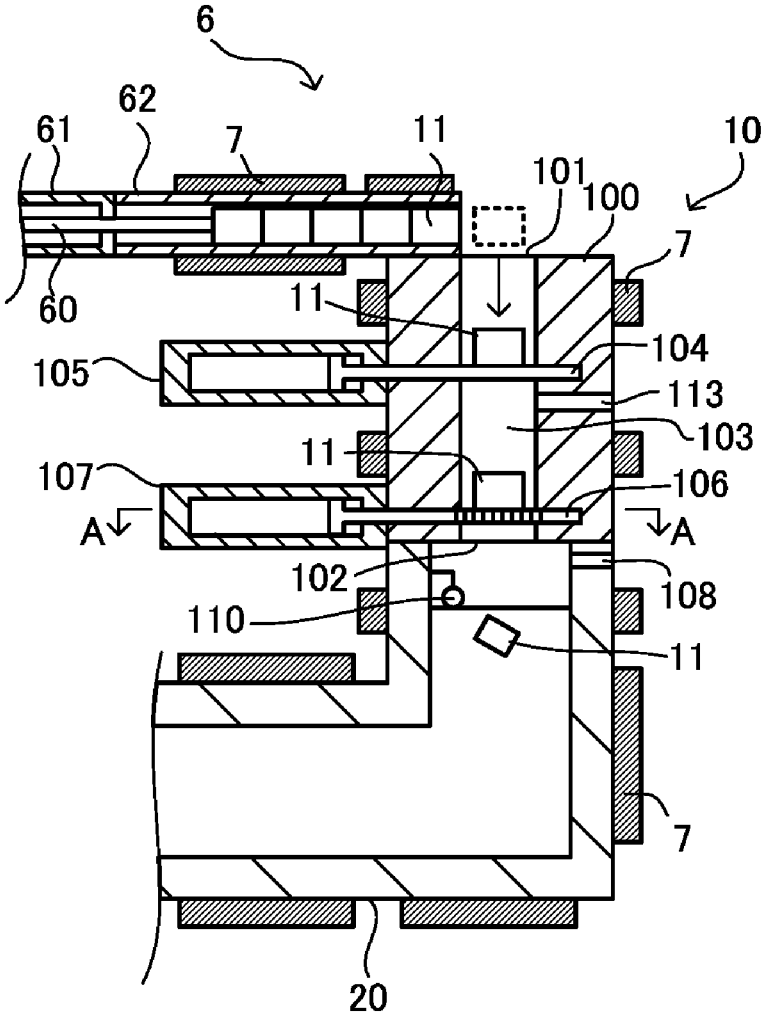
FIG. 5 is an enlarged view of the material supply device, showing a state where the molding material is fed from a material push-out device to the upper shutter.

As shown in FIG. 1 and FIG. 2, the injection device 1 includes a material supply device 10. FIG. 3 to FIG. 5 show the material supply device 10 with enlarged views. As shown in FIG. 2, an amount of the molten metal in the melting cylinder 20 decreases every time the injection device 1 measures and injects the molten metal. When the molten metal in the melting cylinder 20 drops below a predetermined amount, the material supply device 10 supplies the molding material 11 into the melting cylinder 20. The molding material 11 which is immersed in the molten metal in the melting cylinder 20 melts and becomes molten metal.

The material supply device 10 includes a supply cylinder 100. The supply cylinder 100 has a passage 103 that communicates vertically, a supply opening 101 disposed on an upper side of the passage 103, and a discharge opening 102 disposed on a lower side of the passage 103. The discharge opening 102 is connected to the material supply port 21 of the melting cylinder 20. The molding material 11 fed from the supply opening 101 is discharged from the discharge opening 102 to the material supply port 21 through the passage 103. The supply cylinder 100 has a shape that allows the molding material 11 to pass through. For example, the supply cylinder 100 may have a circular or polygonal cross section. The material supply device 10 may be provided with a heater 7 and preheated at a temperature that does not melt the molding material 11. By preheating the molding material 11 in advance, the molding material 11 supplied to the melting cylinder 20 can be melted rapidly, and a sudden drop of the temperature of the molten metal in the melting cylinder 20 is suppressed.

The supply cylinder 100 is provided with a lower shutter 106 to open and close the passage 103. Preferably, an upper shutter 104 to open and close the passage 103 is further disposed above the lower shutter 106 in the supply cylinder 100. An upper shutter driving device 105 moves the upper shutter 104 forward to close the passage 103 and moves the upper shutter 104 backward to open the passage 103. A lower shutter driving device 107 moves the lower shutter 106 forward to close the passage 103 and moves the lower shutter 106 backward to open the passage 103. Various types of driving actuators such as hydraulic type, pneumatic type and electric type may be selected appropriately to serve as the upper shutter driving device 105 and the lower shutter driving device 107.

When the upper shutter 104 closes the passage 103, the molding material 11 fed from the supply opening 101 may be placed on the upper shutter 104. Also, when the upper shutter 104 closes the passage 103, the upper shutter 104 blocks a space above the upper shutter 104 and a space below the upper shutter 104 from each other. That is, the closed upper shutter 104 does not allow gas such as an inert gas and the molding material 11 to pass.

Figure 6:
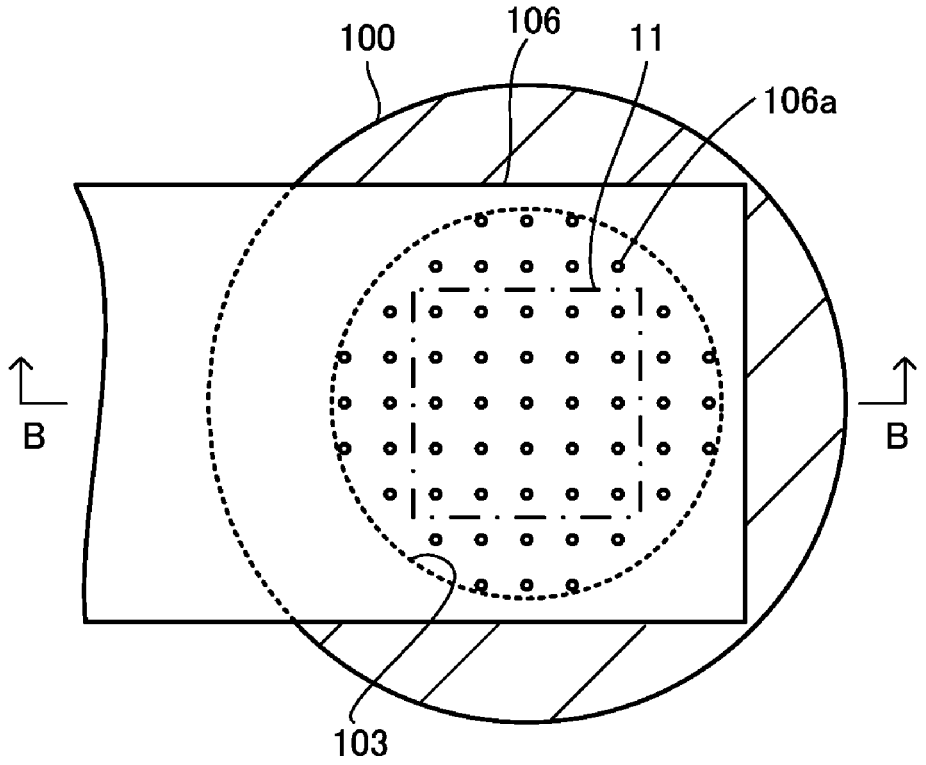
FIG. 6 is a cross-sectional view taken along the line A-A in FIG. 5.
Figure 7:
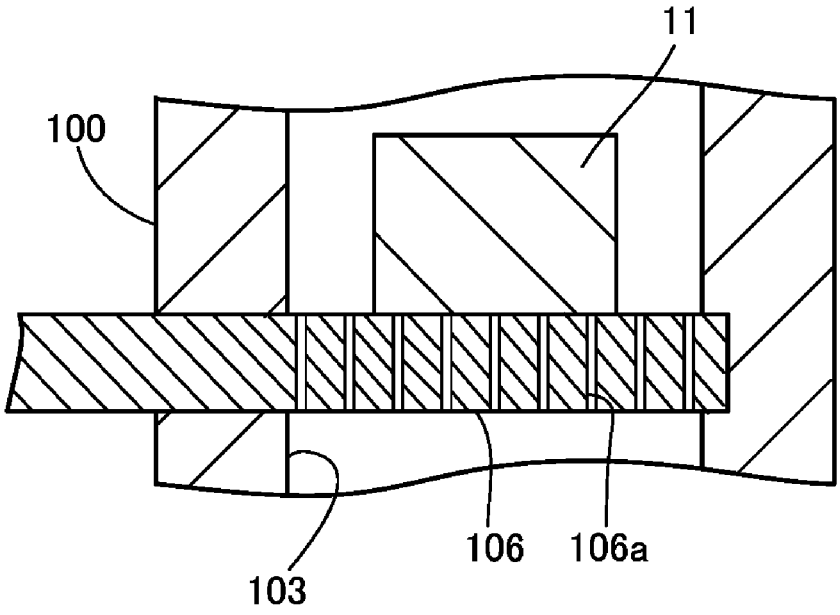
FIG. 7 is a cross-sectional view taken along the line B-B in FIG. 6.

When the lower shutter 106 closes the passage 103, the fed molding material 11 may be placed on the lower shutter 106. The lower shutter 106 has at least one vent-hole **106*a* that communicates a space above the lower shutter 106 and a space below the lower shutter 106 with each other when the passage 103 is closed. Preferably, the lower shutter 106 has a plurality of vent-holes 106*a*. As shown in FIG. 6 and FIG. 7, the vent-holes 106*a* penetrate the lower shutter 106 vertically. The vent-holes 106*a* allow gas such as the inert gas to pass but does not allow the molding material 11** to pass.

A height of a liquid surface of the molten metal in the melting cylinder 20 may be detected by a level sensor 110. Various types of sensors such as floating type, optical type, ultrasonic type, electrode type, and differential pressure type may be used as the level sensor 110.

The space below the lower shutter 106 is filled with the inert gas that is supplied from an inert gas supplier 109 through an inlet 108. The inert gas refers to a gas that does not substantially react with the molding material 11 and the molten metal. It is desirable that the inert gas has a larger specific gravity than a specific gravity of air. The inert gas is argon, for example. The inert gas supplier 109 supplies the inert gas having a predetermined concentration. Specifically, the inert gas supplier 109 may be an inert gas generator that generates the inert gas having the predetermined concentration from surrounding air. Various types of generators such as membrane separation type and PSA type, corresponding to a type and concentration of the inert gas to be generated, may be adopted as the inert gas generator. Also, the inert gas supplier 109 may be a gas cylinder for storing the inert gas having the predetermined concentration.

The inlet 108 is disposed at a position below the lower shutter 106. For example, the inlet 108 may be disposed above the liquid surface of the molten metal of the melting unit 2. For example, the inlet 108 may be disposed below the lower shutter 106 of the supply cylinder 100. One end of the inlet 108 is connected to the space below the lower shutter 106, and the other end is connected to the inert gas supplier 109 via a switching valve 111 and a throttle valve 112. The switching valve 111 opens and closes a flow path of the inert gas. The throttle valve 112 adjusts a flow rate of the inert gas.

The inert gas supplied from the inert gas supplier 109 is supplied to the space below the lower shutter 106 and then further supplied to the space above the lower shutter 106 through the vent-holes **106*a* of the lower shutter 106. The inert gas is ejected upward from the vent-holes 106*a* formed on the lower shutter 106. The inert gas supplied from the vent-holes 106*a* pushes up the gas that exists in the supply cylinder 100. The gas pushed up by the inert gas is discharged from an outlet 113. The gas that exists in the supply cylinder 100 from the beginning mainly contains air. Therefore, if the specific gravity of the inert gas is larger than the specific gravity of the air, the inert gas can gradually push up the gas that exists in the supply cylinder 100 from the beginning more preferably toward the outlet 113** from below.

The outlet 113 is disposed at a position above the lower shutter 106 of the supply cylinder 100. The outlet 113 is preferably disposed between the upper shutter 104 and the lower shutter 106 of the supply cylinder 100. The outlet 113 communicates with an outside of the supply cylinder 100 through a check valve 114. The check valve 114 prevents the gas from flowing back into the space above the lower shutter 106 from the outlet 113. An oxygen concentration detector 115 is disposed between the outlet 113 and the check valve 114. The oxygen concentration detector 115 detects an oxygen concentration of the gas discharged from the outlet 113. If a value detected by the oxygen concentration detector 115 is equal to or smaller than a predetermined value, it is known that the gas in the space above the lower shutter 106 is sufficiently replaced with the inert gas. If the gas in the space above the lower shutter 106 is sufficiently replaced with the inert gas, the supply of the inert gas may be stopped. In this way, an amount of consumption of the inert gas can be reduced.

The injection device 1 may include a material feeding mechanism that feeds the molding material 11 to the supply opening 101 of the material supply device 10 at a predetermined timing. The material feeding mechanism is, for example, a material push-out device 6. The material push-out device 6 is disposed above the material supply device 10 and is connected to the supply opening 101. The material push-out device 6 includes a pusher 60, a pusher driving device 61, and a storing chamber 62. The storing chamber 62 stores at least one molding material 11. The pusher 60 pushes out the molding material 11 in the storing chamber 62 and sequentially feeds the molding material 11 into the supply opening 101. The molding material 11 is fed to the supply opening 101 one by one, for example. Various types of driving actuators such as hydraulic type, pneumatic type and electric type may be selected appropriately to serve as the pusher driving device 61 for reciprocating the pusher 60. The material push-out device 6 may be provided with a heater 7 and preheated at a temperature that does not melt the molding material 11. The material feeding mechanism may have other configurations as long as it can feed the molding material 11 to the supply opening 101. For example, the material feeding mechanism may include an arm for gripping the molding material 11, and a lifting device for raising and lowering the arm. At this time, the molding material 11 gripped by the arm is supplied from the supply opening 101 by the lifting device and is released from the arm at a predetermined position.

The material supply device 10 includes a material supply controller (not shown) for operating each part of the material supply device 10. For example, the level sensor 110 and the oxygen concentration detector 115 are connected to the material supply controller, and the material supply controller controls the upper shutter driving device 105, the lower shutter driving device 107, and the switching valve 111. The material supply controller may also serve as a controller of the material push-out device 6. For example, the material supply controller controls the pusher driving device 61. In addition, the material supply controller may be provided separately from the controller of the light metal injection molding machine, or may be incorporated into the controller of the light metal injection molding machine.

An operation of the material supply device 10 will be described hereinafter. The injection device 1 repeatedly supplies the molten metal in the melting unit 2 to the injection unit 3 and injects the molten metal in the injection unit 3 into the mold. The state shown in FIG. 1 will be described first. The melting unit 2 is filled with the molten metal. The upper shutter 104 and the lower shutter 106 are closed and the molding material 11 is placed on the upper shutter 104 and the lower shutter 106 respectively. The inert gas is supplied to the space above the lower shutter 106 via the vent-holes 106*a*. At this time, the gas in the space above the lower shutter 106 is replaced with the inert gas, and the value detected by the oxygen concentration detector 115 becomes equal to or smaller than the predetermined value. Deterioration of the molten metal and the molding material 11 placed on the lower shutter 106 is suppressed by the inert gas.

The height of the liquid surface of the molten metal in the melting unit 2 is constantly detected by the level sensor 110. As the measurement and injection are repeated, the amount of the molten metal in the melting unit 2 decreases and the height of the liquid surface of the molten metal gradually decreases as shown in FIG. 2.

When the molten metal in the melting unit 2 reaches a predetermined amount or less and the height of the liquid surface of the molten metal detected by the level sensor 110 becomes equal to or smaller than a predetermined value, the lower shutter 106 is opened. As shown in FIG. 3, when the lower shutter 106 is opened, the molding material 11 placed on the lower shutter 106 falls due to its own weight. The molding material 11 that falls is discharged from the discharge opening 102 and supplied to the material supply port 21. The molding material 11 supplied from the material supply port 21 into the molten metal of the melting unit 2 is melted into the molten metal. Nevertheless, the molding material 11 may be supplied only when the space above the lower shutter 106 is filled with a sufficient amount of inert gas. That is, the lower shutter 106 may be opened when the value of oxygen concentration detected by the oxygen concentration detector 115 is equal to or smaller than the predetermined value and the value of the liquid surface of the molten metal detected by the level sensor 110 is equal to or smaller than the predetermined value.

If the upper shutter 104 is opened after the lower shutter 106 is closed again, the molding material 11 placed on the upper shutter 104 falls due to its own weight. As shown in FIG. 4, the molding material 11 that falls is placed on the closed lower shutter 106.

After the upper shutter 104 is closed again, the pusher 60 of the material push-out device 6 pushes out the molding material 11 in the storing chamber 62. The pushed molding material 11 falls to the supply opening 101 of the material supply device 10 due to its own weight. As shown in FIG. 5, the molding material 11 that falls is placed on the closed upper shutter 104.

The above operation is performed repeatedly when the molten metal in the melting unit 2 reaches the predetermined amount or less. According to the light metal injection molding machine, the space of the material supply device 10 near the material supply port 21 is filled with the inert gas rapidly and uniformly. In particular, since the inert gas is rapidly filled above the lower shutter 106, deterioration of the molding material 11 placed on the lower shutter 106 is prevented. Also, since the molding material 11 is supplied from the lower shutter 106 that is disposed at a position relatively close to the liquid surface of the molten metal, when the molding material 11 falls into the molten metal, ripples on the molten metal or splash of the molten metal are suppressed.

If the value detected by the oxygen concentration detector 115 exceeds the predetermined value, the inert gas supplier 109 supplies the inert gas from the inlet 108 to the space below the lower shutter 106. If the value detected by the oxygen concentration detector 115 is equal to or smaller than the predetermined value, the inert gas supplier 109 may not supply the inert gas to the space below the lower shutter 106.

Alternatively, the inert gas supplier 109 may constantly supply the inert gas from the inlet 108 to the space below the lower shutter 106.

If the inert gas is a gas (such as argon) heavier than air, the inert gas first accumulates in the space below the lower shutter 106 and then flows into the space above the lower shutter 106 through the vent-holes 106*a* of the lower shutter 106. The inert gas supplied from the vent-holes 106*a* is ejected upward and fills the space above the lower shutter 106 from below, and the inert gas gradually fills upward. In this way, the gas in the space above the lower shutter 106 is replaced with the inert gas more uniformly and rapidly.

The vent-holes 106*a* are preferably arranged at equal intervals. The vent-hole 106*a* has a size that allows the gas such as an inert gas to pass but does not allow the molding material 11 and material scraps that peel off from the molding material 11 to pass. Specifically, an inner diameter of the vent-hole 106*a* is 2.5 mm or less, preferably 2.0 mm or less. In addition, in order to facilitate processing of the vent-hole 106*a*, the inner diameter of the vent-hole 106*a* is 0.5 mm or more, preferably 1.0 mm or more.

In the case where the amount of molten metal in the melting unit 2 is still insufficient even if the material supply device 10 supplies the molding material 11 once, the material supply device 10 may supply the molding material 11 more than once till the molten metal exceeds the predetermined amount. Further, the material supply device 10 may supply a plurality of molding materials 11 at a time.

The disclosure described above can be implemented in various other forms without departing from the spirit and essential features of the disclosure. Accordingly, the embodiments described herein are illustrative and the disclosure should not be construed as being limited thereto.

What is claimed is:

1. A light metal injection molding machine, comprising:

a melting unit comprising a material supply port supplying a molding material which is a light metal, and melting the molding material to generate a molten metal;

a material supply device supplying the molding material to the material supply port; and an inert gas supplier supplying an inert gas to the material supply device, wherein the material supply device comprises:

a supply cylinder comprising a passage which extends vertically, a supply opening which is disposed on an upper side of the passage and to which the molding material is fed, and a discharge opening which is disposed on a lower side of the passage and discharges the molding material to the material supply port; and a lower shutter disposed in the supply cylinder to open and close the passage, wherein the molding material is placed on the lower shutter when the passage is closed, wherein the lower shutter has at least one vent-hole that allows the inert gas supplied from below the lower shutter to pass when the passage is closed.

2. The light metal injection molding machine according to claim 1, wherein the material supply device further comprises an upper shutter disposed above the lower shutter of the supply cylinder to open and close the passage.

3. The light metal injection molding machine according to claim 2, wherein in a state where the upper shutter closes the passage, the molding material is fed from the supply opening and the molding material is placed on the upper shutter.

4. The light metal injection molding machine according to claim 3, wherein in a state where the lower shutter closes the passage and the molding material is placed on the upper shutter, the upper shutter opens the passage and the molding material is placed on the lower shutter.

5. The light metal injection molding machine according to claim 2, wherein the material supply device further comprises an outlet disposed between the upper shutter and the lower shutter of the supply cylinder and discharging a gas pushed up by the inert gas.

6. The light metal injection molding machine according to claim 5, further comprising an oxygen concentration detector detecting an oxygen concentration of the gas discharged from the outlet, wherein the inert gas is supplied when a value of the oxygen concentration detected by the oxygen concentration detector exceeds a predetermined value, and supply of the inert gas is stopped when the detected value of the oxygen concentration is equal to or smaller than the predetermined value.

7. The light metal injection molding machine according to claim 5, further comprising an oxygen concentration detector detecting an oxygen concentration of the gas discharged from the outlet and a level sensor detecting a height of a liquid surface of the molten metal, wherein when a value of the oxygen concentration detected by the oxygen concentration detector is equal to or smaller than a predetermined value, and a value of the liquid surface of the molten metal detected by the level sensor is equal to or smaller than a predetermined value, the lower shutter on which the molding material is placed is opened.

8. The light metal injection molding machine according to claim 1, wherein in a state where the molding material is placed on the lower shutter, the lower shutter opens the passage and supplies the molding material from e discharge opening to the material supply port.

9. The light metal injection molding machine according to claim 1, wherein the melting unit further comprises an inlet disposed above a liquid surface of the molten metal and supplying the inert gas.

10. The light metal injection molding machine according to claim 1, wherein the material supply device further comprises an inlet disposed below the lower shutter and supplying the inert gas.

11. The light metal injection molding machine according to claim 1, wherein the material supply device further comprises an outlet disposed above the lower shutter of the supply cylinder and discharging a gas pushed up by the inert gas.

12. The light metal injection molding machine according to claim 1, further comprising a level sensor detecting a height of a liquid surface of the molten metal, wherein when a value of the liquid surface of the molten metal detected by the level sensor is equal to or smaller than a predetermined value, the lower shutter on which the molding material is placed is opened.

13. The light metal injection molding machine according to claim 1, further comprising a material push-out device which comprises:

a storing chamber storing the molding material; and a pusher pushing out the molding material in the storing chamber to feed the molding material to the supply opening.

14. The light metal injection molding machine according to claim 1, wherein a specific gravity of the inert gas is larger than a specific gravity of air.

15. The light metal injection molding machine according to claim 14, wherein the inert gas is argon.

16. The light metal injection molding machine according to claim 1, wherein the at least one vent-hole comprises a plurality of vent-holes.

17. The light metal injection molding machine according to claim 1, wherein an inner diameter of each of the at least one vent-hole is 2.5 mm or less.

* * * * *